US008720018B2

(12) United States Patent
Yoshie et al.

(10) Patent No.: US 8,720,018 B2
(45) Date of Patent: May 13, 2014

(54) SIDE RELEASE BUCKLE AND LOCK MEMBER FOR SAME

(75) Inventors: Kenichi Yoshie, Taipei (TW); Ming Yi Huang, Taipei (TW)

(73) Assignee: YKK Corporation (JP)

( * ) Notice: Subject to any disclaimer, the term of this patent is extended or adjusted under 35 U.S.C. 154(b) by 30 days.

(21) Appl. No.: 13/518,887

(22) PCT Filed: Dec. 25, 2009

(86) PCT No.: PCT/JP2009/071607

§ 371 (c)(1),
(2), (4) Date: Jun. 24, 2012

(87) PCT Pub. No.: WO2011/077551

PCT Pub. Date: Jun. 30, 2011

(65) Prior Publication Data

US 2012/0260474 A1 Oct. 18, 2012

(51) Int. Cl.
*A44B 11/26* (2006.01)

(52) U.S. Cl.
USPC ..... 24/625; 24/615; 24/616; 24/633

(58) Field of Classification Search
CPC .. A44B 11/266; A44B 11/263; A44B 11/005; A44B 11/12; A44B 11/25; A44B 11/2592
USPC ..... 24/170, 200, 615, 616, 625, 633, 635, 24/637
See application file for complete search history.

(56) References Cited

U.S. PATENT DOCUMENTS

| | | | | | |
|---|---|---|---|---|---|
| 4,679,282 | A | * | 7/1987 | Feng | 24/614 |
| 4,800,629 | A | * | 1/1989 | Ikeda | 24/170 |
| 4,831,694 | A | * | 5/1989 | Kong | 24/625 |
| 5,113,556 | A | * | 5/1992 | Murai et al. | 24/633 |
| 5,144,725 | A | * | 9/1992 | Krauss | 24/625 |
| 5,311,649 | A | * | 5/1994 | Suh | 24/625 |
| 5,419,020 | A | * | 5/1995 | Murai | 24/625 |

(Continued)

FOREIGN PATENT DOCUMENTS

| | | | |
|---|---|---|---|
| JP | 64-28106 | | 2/1989 |
| JP | 4-221502 | A | 8/1992 |
| JP | 3009366 | | 12/1999 |
| KR | 10-1993-008620 | B | 9/1993 |

OTHER PUBLICATIONS

International Search Report and Written Opinion, PCT International Application No. PCT/JP2009/071607, mailed Apr. 6, 2010.

*Primary Examiner* — Robert J Sandy
*Assistant Examiner* — David Upchurch
(74) *Attorney, Agent, or Firm* — Kilpatrick Townsend & Stockton LLP

(57) ABSTRACT

The lock member includes: a plate-like base portion positioned on a top side of the socket; a holder retaining the base portion to the socket; an operating portion connected to the base portion and movable in a direction intersecting the base portion by an external operation; and a lock portion restricting disengagement of the engaged portions and the engaging portions. The lock portion is positioned in the socket and connected to the operating portion via a joint inserted in the cutout. Without the external operation, the lock portion is present in movement paths where the engaging portions move to be disengaged from the engaged portions. When the operating portion is moved by the external operation, the lock portion is moved away from the movement paths.

6 Claims, 9 Drawing Sheets

(56) References Cited

U.S. PATENT DOCUMENTS

| | | | | |
|---|---|---|---|---|
| 5,548,879 | A * | 8/1996 | Wu | 24/625 |
| 5,953,798 | A * | 9/1999 | Matoba et al. | 24/615 |
| 6,061,883 | A * | 5/2000 | Uehara | 24/625 |
| 7,100,252 | B2 * | 9/2006 | Anscher | 24/615 |
| 7,219,406 | B2 * | 5/2007 | Chui | 24/625 |
| 2006/0168783 | A1 * | 8/2006 | Anscher | 24/615 |
| 2009/0094809 | A1 * | 4/2009 | Kung | 24/625 |
| 2009/0178253 | A1 * | 7/2009 | Yang | 24/625 |

* cited by examiner

SIDE RELEASE BUCKLE AND LOCK MEMBER FOR SAME

This application is a national stage application of PCT/W2009/071607 which is incorporated herein by reference.

TECHNICAL FIELD

The present invention relates to a side release buckle and a lock member therefor. In particular, the present invention relates to a side release buckle that is provided with a pair of lock arms and has a double lock function.

BACKGROUND ART

For coupling a string member such as a belt in various applications such as clothes, bags, shoes and packages, there has been typically used a buckle whose plug and socket are detachably connected to each other.

Such a buckle should be easy to handle for connection and separation of the plug and the socket and should be prevented from unintentional and accidental separation of the plug and the socket. As a product responding to such needs, a side release buckle including a lateral pair of lock arms has been used.

A typical side release buckle includes a plug and a socket, each of which is provided with a belt attachment (see Patent Literature 1 and Patent Literature 2).

The plug includes: a plug base including the belt attachment; and a lateral pair of legs (lock arms) disposed on a socket-opposed side of the plug body. The socket includes a hollow cylindrical socket body. The socket body has a housing space (cavity) into which the plug is inserted from a plug-opposed side of the socket body. Engaged portions being engageable with engaging portions of the legs are formed in the housing space. Thus, when the plug is brought adjacent to the socket and the legs are inserted into the housing space, the plug is engaged with the socket. The socket body has openings formed on the lateral sides thereof. The openings communicate with the housing space, so that the pair of legs are projected from the openings. When the legs projected from the openings are held by hand and deformed to approach each other, the plug and the socket can be disengaged from each other.

When such a side release buckle is held by hand, the legs are accidentally pushed and thus the plug and the socket are unintentionally disengaged from each other. Accordingly, in order to avoid such unintentional disengagement, a double lock side release buckle has been provided.

A buckle disclosed in Patent Literature 1 is a double lock side release buckle including: a side release lock mechanism provided by a lateral pair of legs (first and second legs); and a so-called front push lock mechanism provided by a third leg formed between the lateral pair of legs.

For disengaging the plug and the socket of such a side release buckle from each other, the legs on lateral sides of the buckle are pushed inward for disabling the side release lock mechanism while a release button on a top side of the buckle is pushed for disabling the front push lock mechanism.

Thus, even when the buckle is held and the lateral pair of legs are accidentally pushed, lock can be maintained, so that unintentional disengagement between the plug and the socket can be prevented.

A buckle disclosed in Patent Literature 2 includes: a side release lock mechanism provided by a lateral pair of legs; and a movable lock member disposed on a top side of the socket.

A projection of the lock member is brought into contact with the legs in the socket to prevent disengagement of the legs.

In such a side release buckle, as long as the lock member is set at a double lock position, even when the buckle is held and the lateral pair of legs are accidentally pushed, lock can be maintained because the lock member prevents the movement of the legs. Thus, unintentional disengagement between the plug and the socket can be prevented. On the other hand, when the lock member is moved from the double lock position to a release position, the lock member is not in contact with the legs, so that the double lock function is disabled and thus the plug and the socket can be engaged and disengaged in the same manner as those of a typical side release buckle.

CITATION LIST

Patent Literature(s)

Patent Literature 1 Japanese Patent No. 3009366
Patent Literature 2 JP-A-4-221502

SUMMARY OF THE INVENTION

Problem(s) to be Solved by the Invention

The above conventional double lock buckles have the following problems.

The buckle disclosed in Patent Literature 1 employs a double lock mechanism, i.e., a side release lock mechanism and a front push lock mechanism. The side release lock mechanism and the front push lock mechanism are always effective. Thus, even when the double lock mechanism is not required, i.e., only the side release lock mechanism is required for normal use, it is not possible to disable the front push lock mechanism in use. When the double lock mechanism is not required, a complicated operation is necessary for disabling the double lock mechanism.

The buckle disclosed in Patent Literature 2 is capable of switchably enabling and disabling the double lock function with the movable lock member. However, when the double lock function is enabled, not only disengagement but also engagement of the buckle is restricted. In other words, if the lock member of the socket is accidentally moved to the double lock position while the plug and the socket of the buckle are disengaged, it is not possible to engage the plug and the socket with each other simply by inserting the plug. Further, the lock member is unremovably attached to the buckle. Thus, even when the double lock function is not required for a long time, the lock member cannot be removed. Additionally, it is not possible to add the double lock function to a typical side release buckle.

An object of the invention is to provide a side release buckle provided with a lock member that is removably attachable to the buckle and enables double lock upon insertion of a plug of the buckle.

Means for Solving the Problem(s)

According to an aspect of the invention, a side release buckle includes: a plug; a socket into which the plug is inserted for engagement; and a lock member being attachable to the socket to double-lock the plug, in which the plug includes: a plug base including a belt attachment; a pair of legs projecting from the plug base; and engaging portions being formed on the legs, respectively, the socket includes: a socket body including a belt attachment and an insertion opening; a housing space being defined in the socket body and in which the legs inserted through the insertion opening are housed; engaged portions being formed on the socket body and being engageable with the engaging portions, respectively; and a cutout being formed from an edge of the belt attachment toward the insertion opening, the lock member includes: a plate-like base portion being positioned on a top side of the socket; a holder being configured to retain the base portion relative to the socket; an operating portion being connected to the base portion and being movable in a direction intersecting the base portion by an external operation; and a lock portion being configured to restrict disengagement between the engaged portions and the engaging portions, and the lock portion is positioned in the socket and is connected to the operating portion via a joint that is to be inserted in the cutout of the socket, the lock portion being present in movement paths along which the engaging portions move to be disengaged from the engaged portions without the external operation on the operating portion, the lock portion being moved away from the movement paths when the operating portion is moved by the external operation.

According to another aspect of the invention, a lock member is used for a side release buckle including: a plug; and a socket into which the plug is inserted for engagement, the lock member being attachable to the socket to double-lock the plug, in which the plug includes: a plug base including a belt attachment; a pair of legs projecting from the plug base; and engaging portions being formed on the legs, respectively, the socket includes: a socket body including a belt attachment and an insertion opening; a housing space being defined in the socket body and in which the legs inserted through the insertion opening are housed; engaged portions being formed on the socket body and being engageable with the engaging portions, respectively; and a cutout being formed from an edge of the belt attachment toward the insertion opening, the lock member includes: a plate-like base portion being positioned on a top side of the socket; a holder being configured to retain the base portion relative to the socket; an operating portion being connected to the base portion and being movable in a direction intersecting the base portion by an external operation; and a lock portion being configured to restrict disengagement between the engaged portions and the engaging portions, and the lock portion is positioned in the socket and is connected to the operating portion via a joint that is to be inserted in the cutout of the socket, the lock portion being present in movement paths along which the engaging portions move to be disengaged from the engaged portions without the external operation on the operating portion, the lock portion being moved away from the movement paths when the operating portion is moved by the external operation.

In the above aspect, the cutout of the socket may be formed by cutting the socket in a concave manner from the belt attachment side of the socket along an area between the pair of legs, the area being defined when the engaging portions and the engaged portions are engaged, i.e., when the plug is inserted in the socket (a normal connected state). With a connecting portion connecting the pair of legs to each other, the cutout can be formed along an area surrounded by the pair of legs and the connecting portion, the area being defined when the engaging portions and the engaged portions are engaged. Such a cutout contributes to reducing the surface area of the socket body and thus reducing a material as compared with a socket body having no cutout, so that the weight of the buckle can be reduced.

In the above aspect, the outline of the cutout can be in conformity with an inner shape surrounded by the pair of legs and the connecting portion. With this arrangement, while the pair of legs and the connecting portion are prevented from being visible from the cutout, the area of the cutout can be maximized, which results in a maximum weight reduction.

In the above aspect, it is preferable that an edge of the cutout facing the insertion opening has a C-shaped or U-shaped outline. When the edge of the cutout facing the insertion opening is in a C-shape with a smaller depth or a U-shape with a larger depth, the outline of the edge can be in conformity with the inner shape surrounded by the connecting portion (which is generally in a C-shape or U-shape) and the legs. Additionally, since the innermost of such a C-shape or U-shape is in an arc, the outline of the edge has no discontinuous part forming a steep angle and thus stress concentration and deterioration in moldability can be avoided.

In the above aspect, by attaching the lock member to the buckle, which includes the socket provided with the above cutout, a double lock function can be added to the buckle.

The lock portion is attached to the socket with the assistance of the holder and the base portion is retained along the top side of the socket. Simultaneously, the lock portion, which is supported by the operating portion and the joint formed on the base portion, is positioned in the socket through the cutout.

Without the external operation on the operating portion, the lock portion is present in the movement paths along which the engaging portions move to be disengaged from the engaged portions, e.g., between the pair of legs. Thus, even when a normal unlock operation is performed on the side release buckle, i.e., the pair of legs are deformed to approach each other for disengaging the engaging portions from the engaged portions of the socket, the engaging portions are prevented from disengagement from the engaged portions, thereby maintaining engagement between the engaging portions and the engaged portions (a double lock enabled state).

On the other hand, when the operating portion is moved by the external operation, the lock portion, which is connected to the operating portion via the joint, is also moved. The lock portion is thus moved away from the movement paths along which the engaging portions move to be disengaged from the engaged portions. In this manner, the double lock enabled state is canceled, so that the normal unlock operation on the side release buckle can be enabled, i.e., the pair of legs can be deformed to approach each other, thereby disengaging the engaging portions from the engaged portions (a double lock disabled state).

Further, such a double lock function can be eliminated by removing the lock portion from the socket. After the removal of the lock portion, the socket and the plug can be used as those of a common side release buckle.

The dimension of the lock portion may be changed suitably for a typical side release buckle having a cutout. In this manner, the lock portion can be applied to any typical side release buckle used for clothes or bags and thus the double lock function can be added without replacing the buckle.

In the above aspect, it is preferable that the operating portion includes a cantilever being continuous with the base portion and being swingable relative to the base portion.

In the above arrangement, for instance, by forming three slits, i.e., a so-called tonguelike portion, in the plate-like base portion, a cantilever structure can be easily provided. The cantilever can be formed integrally with the base portion. Additionally, the end of the cantilever is movable sufficiently for allowing the movement of the lock portion as required for the operating portion.

In the above aspect, it is preferable that the base portion includes a protrusion-like stopper being brought into contact with a part of the lock portion or the cantilever to restrict excessive displacement of the cantilever.

With the above arrangement, excessive displacement of the cantilever can be restricted by the stopper, thereby preventing the operating portion, which is formed integrally with the base portion, from damage or the like resulting from the excessive displacement.

In the above aspect, it is preferable that the holder includes: a clamp being positioned on a bottom side of the socket; and a stay being configured to connect a surface of the base portion facing the socket to the clamp.

With the above arrangement, the socket can be clamped between the clamp and the base portion on the top and bottom sides thereof, thereby reliably retaining the lock member relative to the socket.

In the above aspect, it is preferable that the holder includes at least one of a clamp nail formed on a surface of the clamp facing the socket and a clamp nail formed on the surface of the base portion facing the socket.

With the above arrangement, at least one of the clamp nail of the clamp and the clamp nail of the base portion can be engaged with the edge of the socket, thereby retaining the lock member relative to the socket with enhanced reliability.

In the above aspect, it is preferable that the holder includes a pair of clamp nails formed on a surface of the base portion facing the socket.

With the above arrangement, a part of the socket can be bitten or clamped by the pair of clamp nails, thereby reliably retaining the lock member relative to the socket.

In the above aspect, it is preferable that the socket is provided with an undulation formed in a top surface of the socket body, and the base portion is partly positioned in a concave of the undulation.

The undulation can be provided by forming the surface of the socket body into a corrugated plate-like shape. When such a corrugated plate-like shape, i.e., the undulation, extends along a direction in which the plug is inserted into the socket, the undulation serves as an insertion guide for the legs, i.e., the engaging portions.

With the above arrangement, since the base portion is at least partly positioned in the concave of the undulation, the protruding height from the surface of the socket is reduced for a favorable appearance.

BRIEF DESCRIPTION OF DRAWING(S)

DESCRIPTION OF EXEMPLARY EMBODIMENT(S)

Exemplary embodiments of the invention will be described below with reference to the attached drawings.

First Exemplary Embodiment

FIGS. 1 to 10 show a first exemplary embodiment of the invention.

Figure 1:
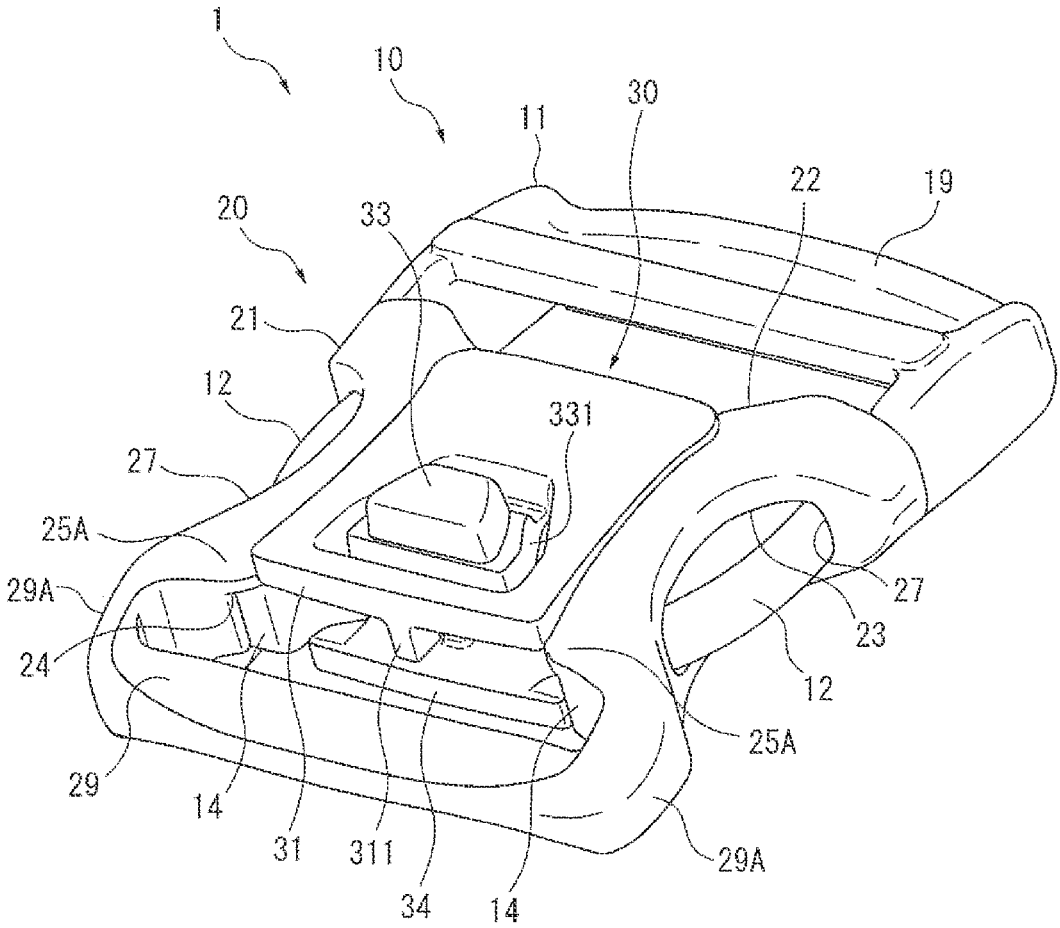
FIG. 1 is a perspective view showing a top side of a buckle in a connected state according to a first exemplary embodiment of the invention.
Figure 2:
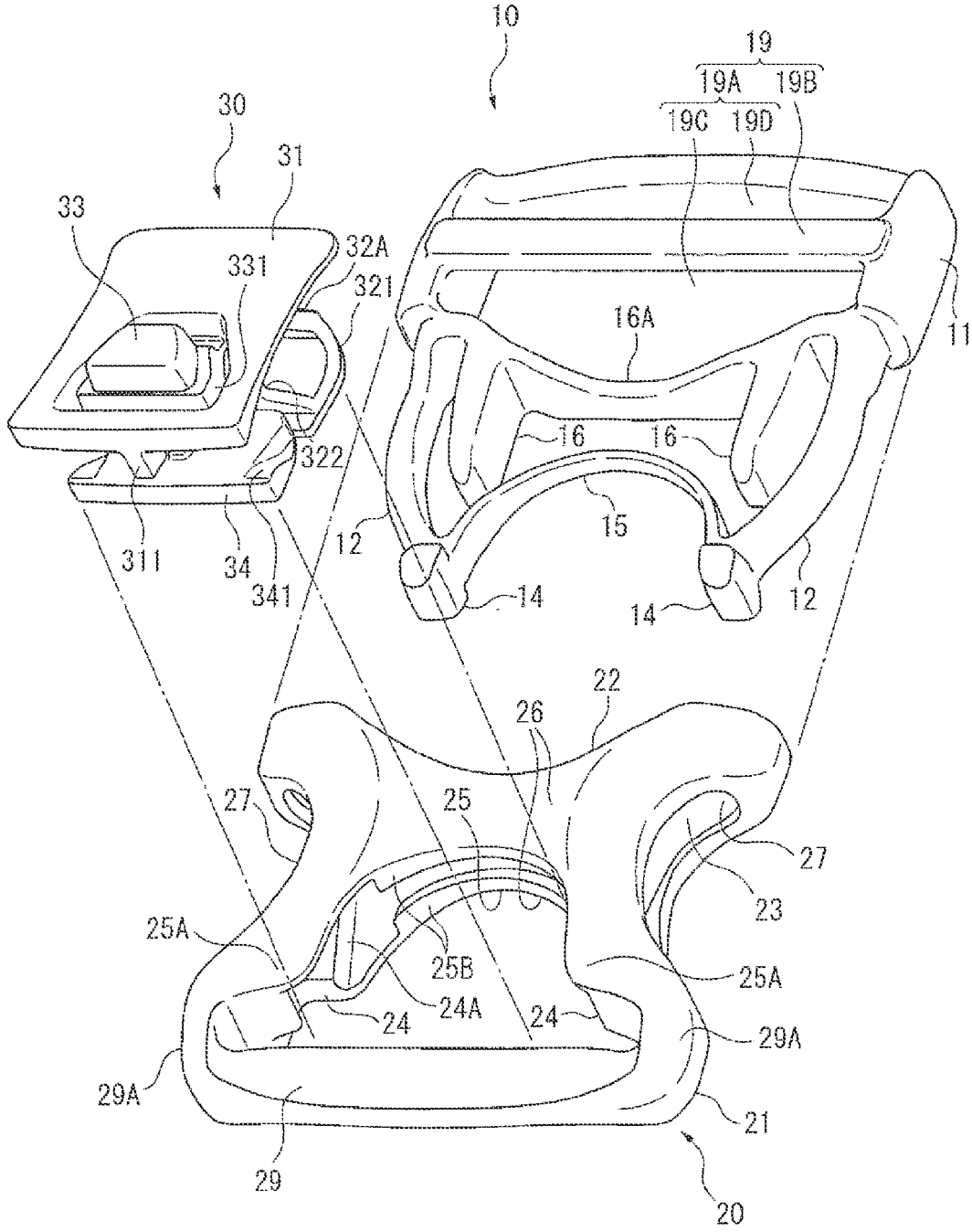
FIG. 2 is a perspective view showing the buckle in a separated state according to the first exemplary embodiment.

As shown in FIGS. 1 and 2, a side release buckle 1 according to this exemplary embodiment is a buckle used to couple and separate the ends of a string member, and includes the following three elements: a plug 10; a socket 20 into which the plug 10 is inserted for engagement; and a lock member 30 being attached to the socket 20 to double-lock the plug 10.

Figure 3:
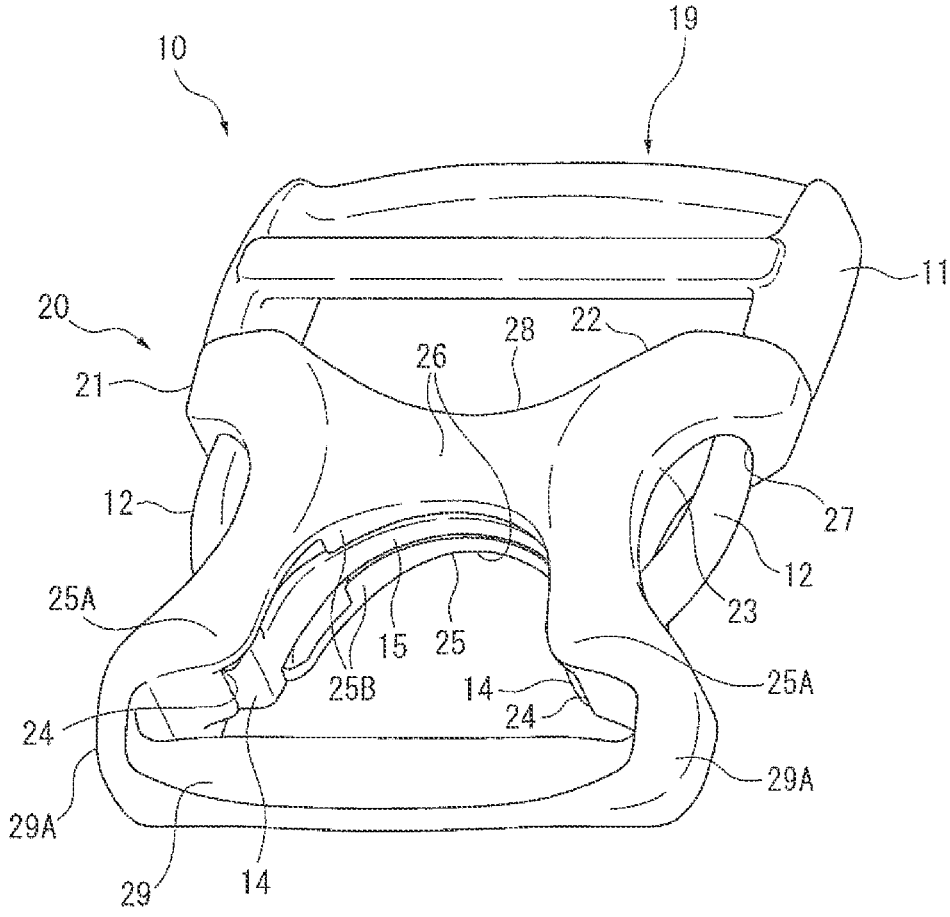
FIG. 3 is a perspective view showing the buckle from which a lock member is removed in use according to the first exemplary embodiment.

As shown in FIG. 3, the lock member 30 may be removed from the side release buckle 1 of this exemplary embodiment in use such that the plug 10 and the socket 20 can be mutually engaged or disengaged. In other words, the side release buckle 1 can be used as a typical side release buckle.

On the other hand, as shown in FIG. 1, the lock member 30 may be attached to the side release buckle 1 in use to add a double lock function, by which the buckle is prevented from unintentional disengagement between the socket 20 and the plug 10.

The plug 10, the socket 20 and the lock member 30 will be described below in detail.

As shown in FIGS. 2 and 3, the entirety of the plug 10 is integrally formed of a synthetic resin material by injection molding. The plug 10 includes a plug base 11 having a belt attachment 19 and a pair of legs 12 projecting from the plug base 11. Each of the pair of legs 12 is provided with an engaging portion 14. Tip ends of the legs 12 are connected to each other via a U-shaped connecting portion 15. A pair of guided portions 16 are disposed between the pair of legs 12. The pair of guided portions 16 are branched from base ends of the legs 12 and are connected to each other via a connecting frame 16A near the plug base 11.

The pair of legs 12 extend from widthwise sides of the plug base 11 in an insertion direction of the plug 10 relative to the socket 20 and are parallel with each other. In each of the legs 12, a portion from the middle to the tip end thereof is elastically deformable in mutually approaching and separating directions. The pair of legs 12 are gradually inclined in the mutually approaching direction toward the tip ends of the legs 12 in the insertion direction and are curved with a predetermined clearance, so that the legs 12 can receive elastic deformation force as a whole.

Each of the engaging portions 14 is formed as a projection extending from the tip end of the leg 12 in a vertical direction (a top-bottom direction of the socket 20) and thus the tip end of the leg 12 is in a T-shape in lateral side view. In other words, each of the engaging portions 14, which is formed at the tip end of the leg 12, has a dimension in a top-bottom direction (height) of the engaging portion 14 larger than the height of the leg 12.

Both sides of the connecting portion 15 extend from the engaging portions 14 at the tip ends of the legs 12 toward the belt attachment 19, respectively, and approach each other to be connected in a U-shape. With this connecting portion 15, the pair of legs 12 can be prevented from being excessively pulled outward by an external force.

Each of the guided portions 16 has the same height as the engaging portion 14 at the tip end of each of the legs 12. An upper periphery of each of the guided portions 16 projects upward beyond an upper periphery of each of the legs 12 while a lower periphery of each of the guided portions 16 projects downward beyond a lower periphery of each of the legs 12. The engaging portions 14 and the guided portions 16 are guided by undulations (described later) formed on a central side of the socket 20 so that the plug 10 is guided to an appropriate position in an insertion operation.

The connecting frame 16A connects opposing portions of the guided portions 16 near the plug base 11. A middle portion of the connecting frame 16A is curved in a manner to project in the insertion direction of the plug 10. The height of the middle portion of the connecting frame 16A in the top-bottom direction is set lower than the height of each of the guided portions 16. The height of the middle portion is increased toward ends of the connecting frame 16A and reaches the height of each of the guided portions 16 at the ends of the connecting frame 16A. Thus, top and bottom surfaces of the connecting frame 16A are gradually dented at respective centers thereof. This shape is in conformity with the outline of a convex 26B formed on an interior surface of a socket body 21 (described later).

Figure 6:
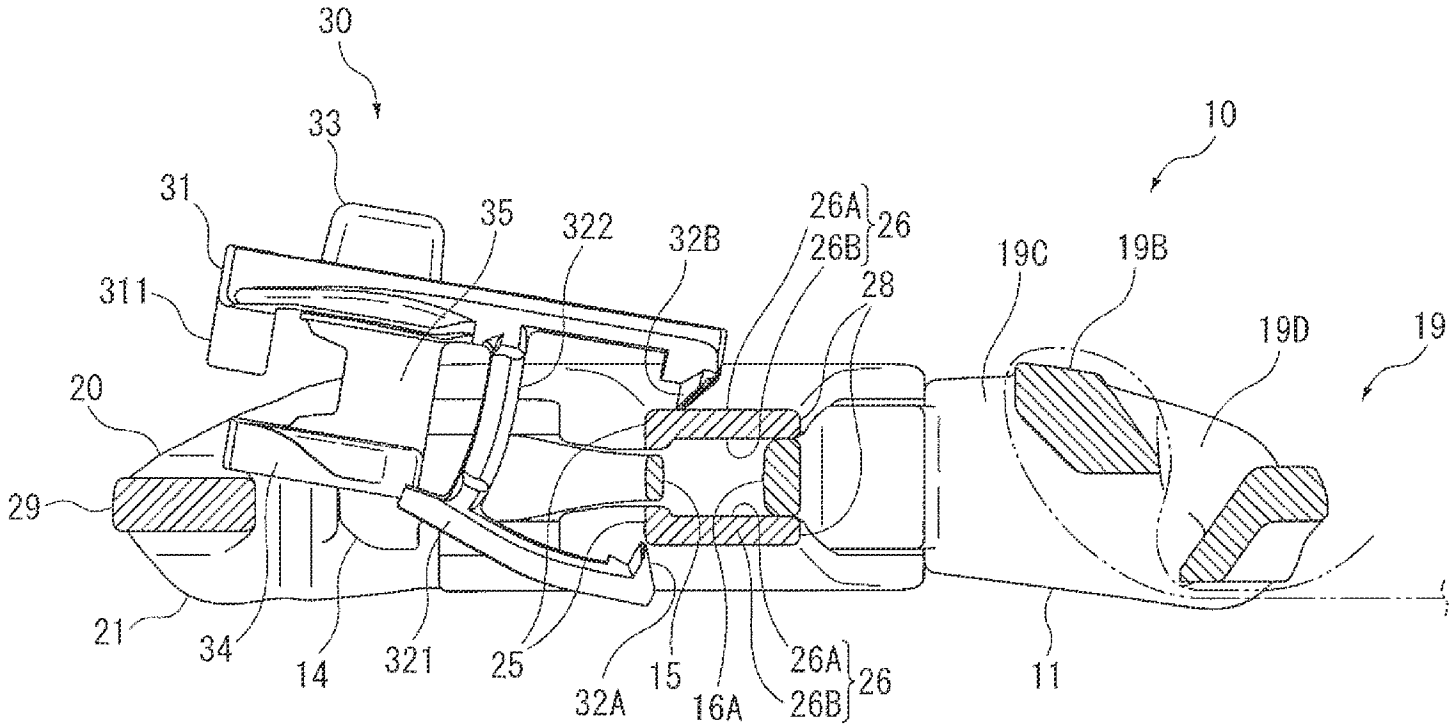
FIG. 6 is a sectional view showing a process of attaching the lock member according to the first exemplary embodiment.
Figure 7:
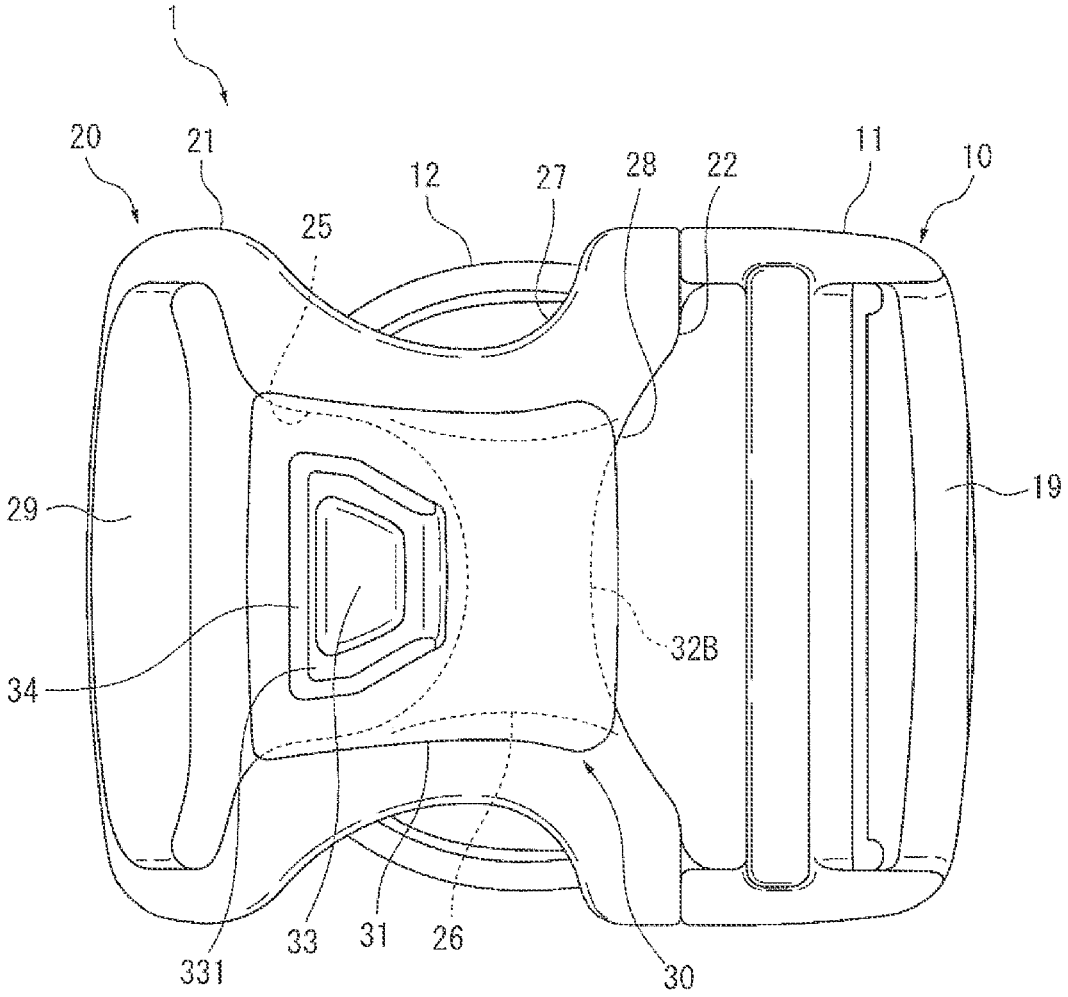
FIG. 7 is a plan view showing the top side of the buckle with the lock member being attached according to the first exemplary embodiment.

The belt attachment 19 is formed in a middle area of the plug base 11. As shown in FIGS. 2 and 6, the belt attachment 19 includes: a string attachment hole 19A (a string attachment portion) into which an end of the string member is inserted for engagement; and a connecting bar 19B bridging over the string attachment portion in the middle thereof. The connecting bar 19B divides the string attachment hole 19A into a front hole 19C in the insertion direction and a rear hole 19D in the insertion direction. With this arrangement, a length of the string member can be adjusted by inserting the string member through the string attachment hole 19A and winding the string member around the connecting bar 19B.

In FIGS. 2 and 3, the entirety of the socket 20 is integrally formed of a synthetic resin by injection molding. The socket 20 includes: a hollow cylindrical socket body 21 including a belt attachment 29 and an insertion opening 22; and a housing space 23 being formed in the socket body 21 and capable of housing the legs 12 of the plug 10 inserted through the insertion opening 22. The socket body 21 further includes: a pair of engaged portions 24 with which the engaging portions 14 of the plug 10 are engageable; and guide surfaces 24A that are formed in the housing space 23 and guide the engaging portions 14 to the engaged portions 24 for engagement.

In a substantially central portion of each of top and bottom sides of the socket body 21, an undulation 26 is formed continuously in an insertion direction of the legs 12. In each of lateral sides of the socket body 21, a manipulation opening 27 is formed for disengagement between the engaging portions 14 and the engaged portions 24.

On each of the top and bottom sides of the socket body 21, a cutout 28 and a cutout 25 extending along the undulation 26 are provided, the cutout 28 being formed by denting a widthwise central portion of the edge of the insertion opening 22 in an arc toward the belt attachment 29, the cutout 25 being formed by denting a widthwise central portion of the edge of a belt-insertion opening of the belt attachment 29 in an arc toward the insertion opening 22. On each of a top-side interior surface and a bottom-side interior surface of the socket body 21, a protrusion 25B is formed and protrudes into the housing space 23.

The engaged portions 24 are provided by steps formed at four positions inside the housing space 23 and facing the belt attachment 29 (the side opposite to the insertion opening 22). Two of the four steps as the engaged portions 24 are formed on a bottom-side interior surface of the socket body 21, and face the housing space 23 and side portions 29A of the belt attachment 29 of the socket body 21. The other two of the four steps are likewise formed on a top-side interior surface of the socket body 21 and covered by projections 25A formed on the top side of the socket body 21. An opposed pair of these steps in the top-bottom direction provides each of the engaged portions 24. The socket 20 according to this exemplary embodiment is provided with the pair of engaged portions 24 arranged in a width direction of the socket 20 such that the engaged portions 24 correspond to the engaging portions 14 formed at the tip ends of the pair of legs 12, respectively.

The guide surfaces 24A are provided by steps formed continuously from the vicinity of both ends of the insertion opening 22 to the engaged portions 24 along the top-side and bottom-side interior surfaces of the socket body 21. When the legs 12 are inserted through the insertion opening 22, the guide surfaces 24A serve as a guide for guiding the engaging portions 14 at the tip ends of the legs 20 to the engaged portions 24. In other words, the engaging portions 14, which are formed at the tip ends of the legs 12 inserted through the insertion opening 22, are guided by the guide surfaces 24A while approaching each other due to the elastic deformation of the pair of legs 12. When the engaging portions 14 reach the engaged portions 24, the elastic deformation of the legs 12 caused by the guide surfaces 24A is recovered, so that the engaging portions 14 are fitted in the engaged portions 24 for mutual engagement.

As shown also in FIG. 6, the undulation 26 includes a concave 26A formed on an exterior surface of the socket body 21 and a convex 26B formed on the interior surface of the socket body 21 in conformity with the concave 26A. A portion between the concave 26A and the convex 26B has the same thickness as the other portion of the socket body 21 and the cross section thereof is like a corrugated plate (i.e., a flat plate having a curved portion).

With such undulations 26 formed on the top and bottom sides of the socket body 21, the opposed central portions of the top and bottom sides of the socket body 21 are each shaped like a corrugated plate curved in a mutually approaching direction. With this arrangement, the rigidity of the substantially central portions, which are most likely to be subjected to a pressing force in the top-bottom direction and thus suffer from cracks, can be ensured, so that crush and cracks can be efficiently prevented.

The undulations 26 are disposed on the top and bottom sides of the socket body 21 at positions corresponding to each other. The mutually opposing convexes 26B of the undulations 26 are disposed to fit in respective dents on the top and bottom surfaces of the connecting frame 16A between the legs 12 inserted in the housing space 23. A gap between the convexes 26B is set smaller than the height of each of the engaging portions 14 and the height of each of the guided portions 16 of the plug 10 (the dimension in the top-bottom direction). When the legs 12 are inserted, the engaging portions 14 and the guided portions 16 are guided along the undulations 26. The undulations 26 provide a guiding function to suitably guide the engaging portions 14 to the engaged portions 24 while adjusting the posture of the plug 10. Since being provided with the dents on the top and bottom surfaces of the connecting frame 16A, the connecting frame 16A between the guided portions 16 can be inserted into the gap of the convexes 26B without interference with the convexes 26B.

The height of the housing space 23 into which each of the guided portions 16 is introduced is set equal to the height of the guided portions 16. While the guided portions 16 remain inserted in the housing space 23, when the socket 20 is pressed in the top-bottom direction, the guided portions 16 support the socket 20 and prevent excessive deformation such as crush in the top-bottom direction.

The manipulation openings 27 are formed on the lateral sides of the socket body 21 and communicate with the housing space 23 inside the socket body 21. The manipulation openings 27 are disposed at such positions that middle portions of the legs 12 inserted through the insertion opening 22 are exposed from the manipulation openings 27. By pressing inward the legs 12 exposed out of the manipulation openings 27, the pair of legs 12 are elastically deformed to approach each other and the engaging portions 14 are released from the engaged portions 24, so that the mutual engagement is released.

For forming the cutout 25 and the cutout 28, the materials of the top and bottom sides of the socket body 21 are concaved near the belt attachment 29 and the insertion opening 22.

The cutout 28 is a C-shaped shallow cutout extending from the insertion opening 22 and the most inward portion is shaped in an arc. The outline of a C-shaped edge of the cutout 28 is in conformity with the inner shape of the connecting frame 16A formed in the plug base 11 of the plug 10. With this outline, while the cutout 28 is maximally enlarged, the plug base 11 is not exposed more than necessary.

The cutout 25 is a U-shaped deep cutout extending from the belt attachment 29. The outline of a U-shaped edge of the cutout 25 is in conformity with the outer shape of the legs 12 and the connecting portion 15. As described above, the tip ends of the pair of legs 12 are connected to each other by the connecting portion 15, the inside of which is in a U-shape as a whole. The outline of the cutout 25 is formed in line with this shape. With this outline, while the cutout 25 is maximally enlarged, the legs 12 and the connecting portion 15 are not exposed.

In the cutout 25 formed on the top side of the socket body 21, portions facing lateral ends of the belt attachment 29 form the projections 25A projecting along the belt attachment 19. Top surfaces of the engaged portions 24 are covered by the projections 25A. The projections 25A prevent the belt inserted in the belt attachment 29 from being improperly lifted up.

The cutout 25 formed on the bottom side of the socket body 21 does not include portions corresponding to the projections 25A. The edge of the cutout 25 is partly formed along the step of each of the engaged portions 24, so that the engaged portions 24 are exposed on the bottom side of the socket body 21.

Each of the protrusions 25B is a continuous protrusion being formed integrally with the socket body 21 and having a substantially rectangular cross section. The protrusion 25B is continuously formed along a part of the edge of the cutout 25 close to the insertion opening 22. The formation area of the protrusion 25B on the edge of the cutout 25 is defined as a predetermined widthwise area laterally extending from the center of the part of the edge of the cutout 25 close to the insertion opening 22. In other words, the formation area of the protrusion 25B is determined such that the protrusion 25B covers an area in which the tip ends of the legs 12 or the engaging portions 14 may be visible in the cutout 25 when the legs 12 of the plug 10 are inserted through the insertion opening 22 of the socket 20 for engagement.

The top-side and bottom-side protrusions 25B are opposed to each other with a gap. The height of the protrusions 25B is determined such that the gap between the protrusions 25B is slightly larger than the height of the connecting portion 15 of the plug 10. With this arrangement, when the plug 10 is inserted in the socket 20, the connecting portion 15 is positioned between the upper and lower protrusions 25B. As a result, when the plug 10 and the socket 20 are engaged with each other, the surfaces of the upper and lower protrusions 25B and the surface of the connecting portion 15 are aligned with a favorable appearance.

The height of the side portions 29A of the belt attachment 29 is larger than that of a belt-winding portion of the belt attachment 29, so that a sufficient connection strength is attained.

Figure 4:
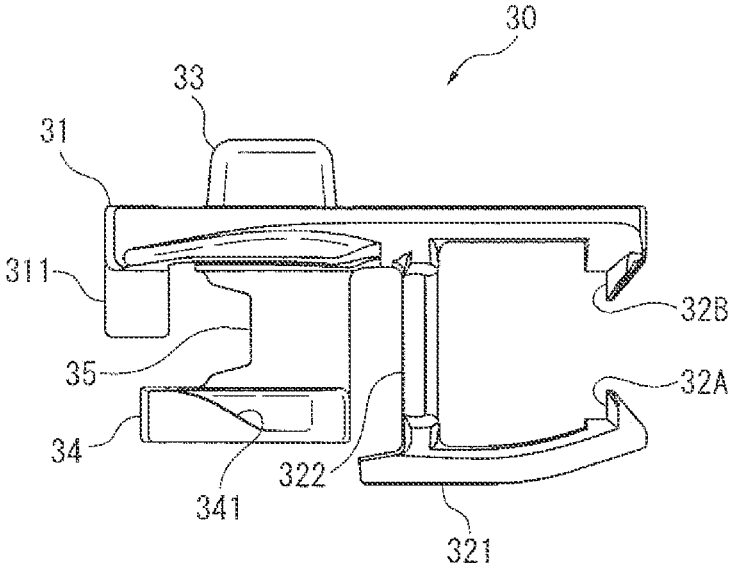
FIG. 4 is a lateral side view showing the lock member according to the first exemplary embodiment.
Figure 5:
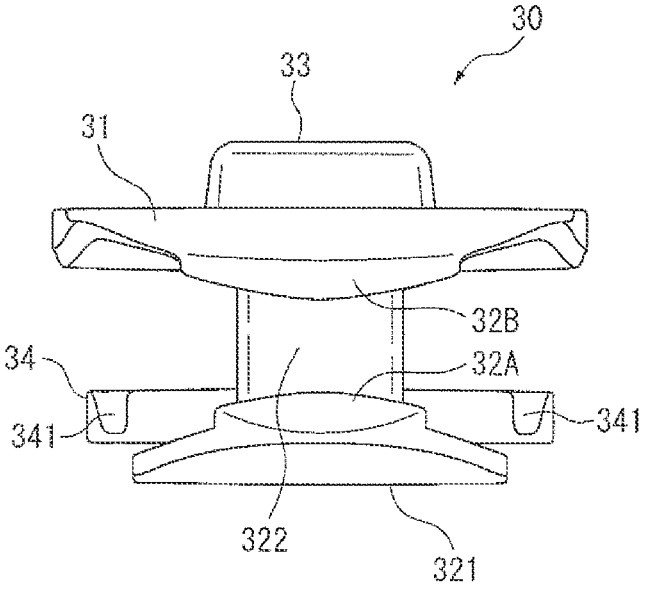
FIG. 5 is a front view showing the lock member according to the first exemplary embodiment.

Referring to FIGS. 2, 4 and 5, the entirety of the lock member 30 is integrally formed of a synthetic resin by injection molding. The lock member 30 includes: a plate-like base portion 31 being disposed on the top side of the socket 20; a holder 32 being configured to hold the base portion 31 relative to the socket 20; an operating portion 33 being connected to the base portion 31 and being movable in a direction intersecting the base portion 31 by an external operation; and a lock portion 34 being configured to restrict disengagement between the engaged portions 24 and the engaging portions 14.

The base portion 31 is a rectangular plate in plan view. When the cross section of the base portion 31 is taken in a width direction of the base portion 31 (i.e., an opposing direction of the engaging portions 14 or a longitudinal direction of the belt attachments 19 and 29), an upper surface of the base portion 31 is flat while and a lower surface is in an arc. The arc is in conformity with the curvature of the undulation 26 of the socket body 21 of the socket 20. As a result, when the base portion 31 is disposed along the undulation 26, more than half of the base portion 31 is positioned in the concave of the undulation 26.

The holder 32 includes: a clamp 321 being positioned on the bottom side of the socket 20; and a stay 322 being configured to connect a surface of the base portion 31 facing the socket 20 to the clamp 321.

Figure 8:
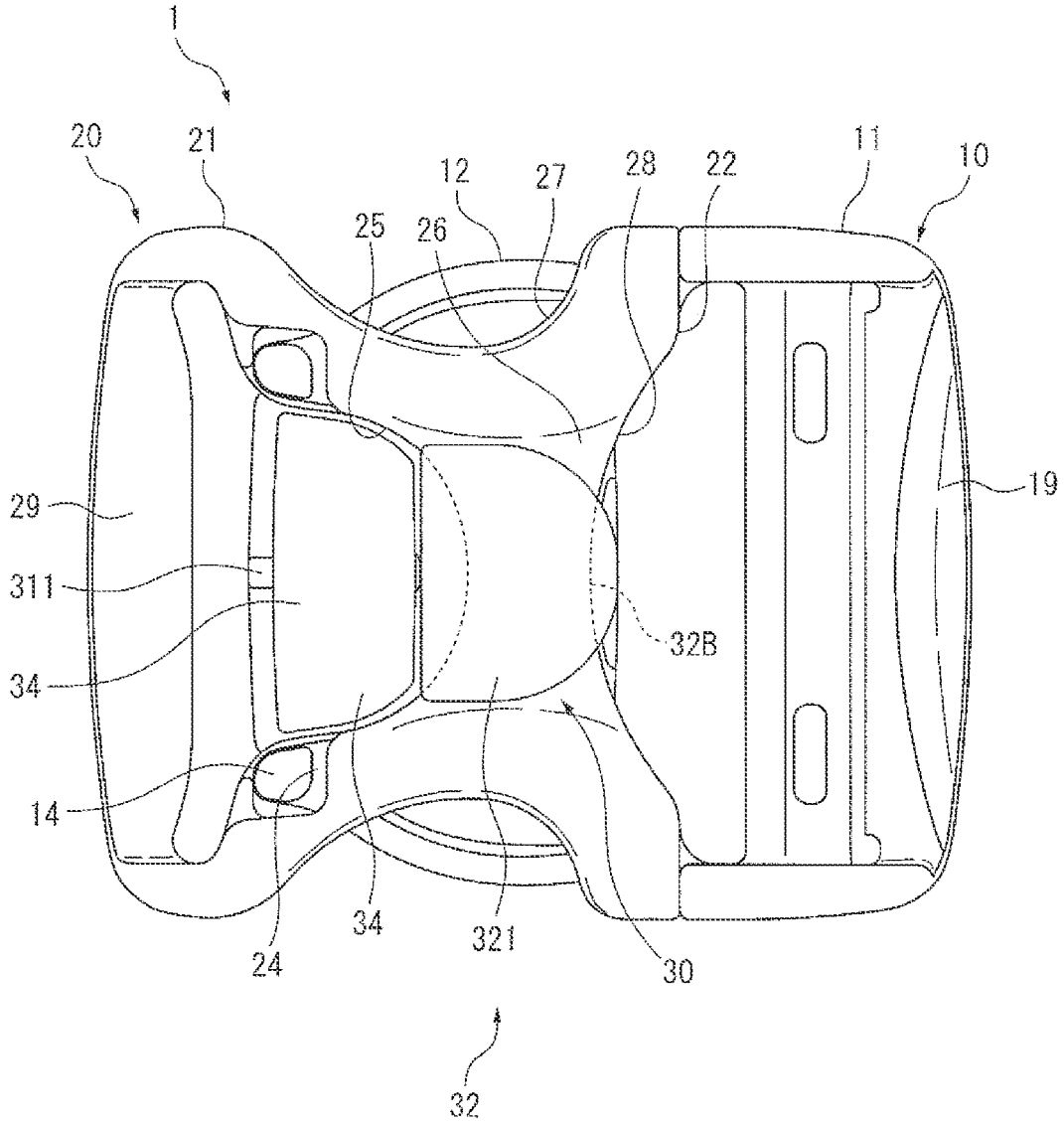
FIG. 8 is a bottom view showing a bottom side of the buckle with the lock member being attached according to the first exemplary embodiment.

As shown in FIG. 8, the clamp 321 is provided by a plate having a semicircular portion facing the plug 10 and is supported substantially in parallel with the base portion 31. An edge of the clamp 321 facing the plug 10 is gently curved to approach the base portion 31.

A clamp nail 32A, which projects toward the socket 20, is formed along an arc-shaped edge of the clamp 321. A clamp nail 32B, which projects toward the socket 20, is formed along an edge of the base portion 31 facing the plug 10. The clamp nails 32A and 32B each have an arc edge as shown in FIG. 5 and have a right triangular cross section as shown in FIG. 4.

When the base portion 31 is positioned along the undulation 26 on the top side, the clamp nails 32A and 32B are engageable with the edges of the cutouts 28 on the top and bottom sides of the socket 20, respectively.

The stay 322 is provided by a plate continuous with the base portion 31 and the clamp 321. The stay 322 is thinner than the base portion 31 and the clamp 321 and is deformable with an external force as shown in FIG. 6.

The holder 32 serves to attach the base portion 31 to the top side of the socket 20 with the assistance of the flexibility of the stay 322. For attachment of the base portion 31, as shown in FIG. 6, the clamp 321 and the lock portion 34 are inserted in the cutout 25 on the top side of the socket 20 such that the central portion of the socket 20, i.e., a narrow portion between the cutout 25 and the cutout 28, is fitted between the base portion 31 and the clamp 321. Since being provided with the undulations 26 as described above, the central portion of the socket 20 has the smallest thickness between the top side and the bottom side of the socket 20. Thus, the central portion of the socket 20 can be easily fitted between the base portion 31 and the clamp 321 with the assistance of the flexibility of the stay 322.

As described above, the holder 32 serves to clamp the central portion of the socket 20, thereby retaining the base portion 31 on the top side of the socket. When the base portion 31 is retained on the top side of the socket 20, the clamp nails 32A and 32B are engaged with the edges of the cutouts 28 on the top and bottom sides of the socket 20, respectively, thereby preventing detachment of the base portion 31 and stabilizing the retained position of the base portion 31 relative to the socket 20.

The operating portion 33 includes a cantilever 331. In the cantilever 331, a side facing the plug 10 is continuous with the base portion 31 and a side facing the belt attachment 29 is swingable relative to the base portion 31. The operating portion 33 further includes a button-like protrusion being formed at the center of a swingable end side thereof. When an external force is applied to the operating portion 33 by, for instance, pushing the protrusion, the side facing the belt attachment 29 is moved relative to the base portion 31.

The lock portion 34 is shaped in a plate connected to the operating portion 33 via a joint 35. The joint 35 is positioned in the socket 20 and inserted in the cutouts 25. As shown in FIGS. 4 and 5, the lock portion 34 is positioned closer to the base portion 31 as compared with the clamp 321.

Without an external operation on the operating portion 33, the lock portion 34 is positioned between the pair of legs 12. On the other hand, when the operating portion 33 is moved upon an external operation, the lock portion 34 is moved away from movement paths of the engaging portions 14.

Figure 9:
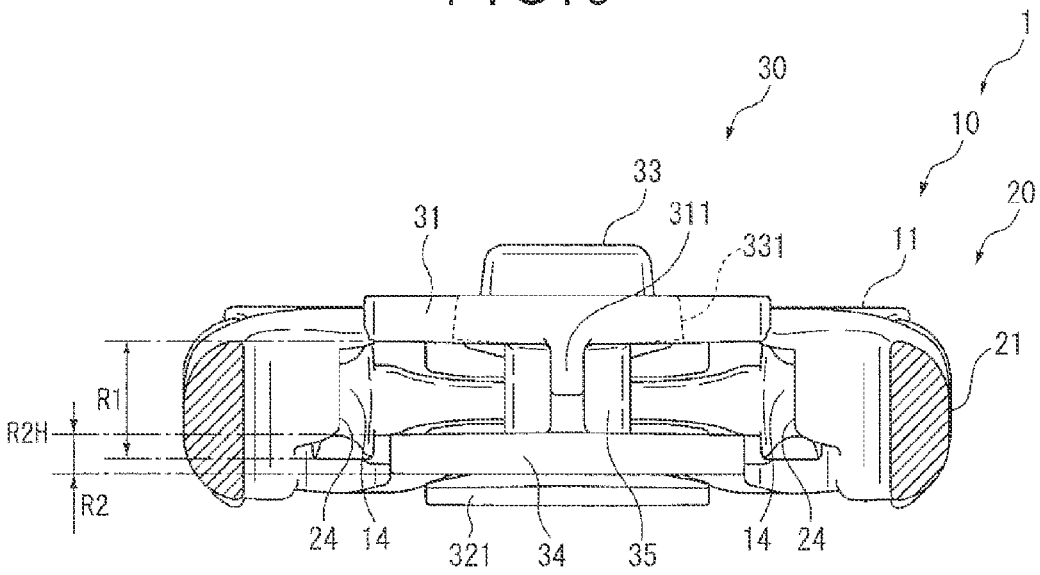
FIG. 9 is a sectional view showing the lock member in a non-operated state according to the first exemplary embodiment.

Referring to FIG. 9, without an external operation on the operating portion 33, the cantilever 331 is positioned within a thickness range of the base portion 31. In this state, the lock portion 34 connected to the operating portion 33 via the joint 35 is positioned closer to the base portion 31 as compared with the clamp 321. When R2 denotes a thickness range of the lock portion 34, R2H denotes an upper end height of the lock portion 34, and R1 denotes a height range of the engaging portions 14, the upper end height R2H is within the height range R1 of the engaging portions 14. Thus, even when the pair of legs 12 are manipulated for moving the engaging portions 14 in the mutually approaching direction (for moving the engaging portions 14 laterally inward to enter the cutouts 25), the engaging portions 14 are brought into contact with the lock portion 34 between the engaging portions 14 (the lock portion 34 is retained in the cutouts 25) and thus are prevented from disengagement from the engaged portions 24 (a double lock enabled state).

Figure 10:
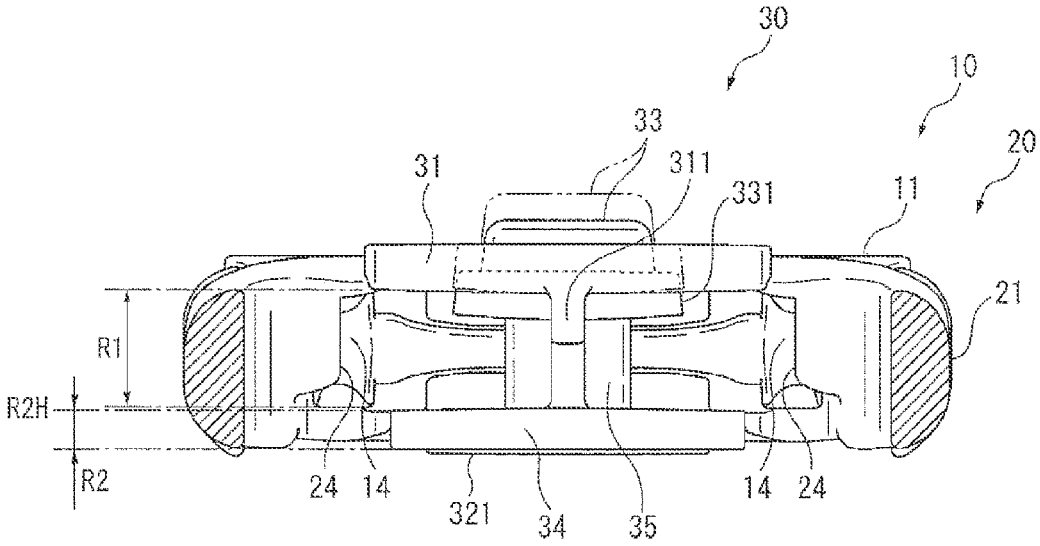
FIG. 10 is a sectional view showing the lock member in an operated state according to the first exemplary embodiment.

Referring to FIG. 10, when the operating portion 33 is moved downward in the figure upon an external operation thereon, the lock portion 34 connected to the operating portion 33 via the joint 35 is also moved downward and thus the upper end height R2H of the lock portion 34 becomes out of the height range R1 of the engaging portions 14. In this state, since the lock portion 34 is moved away from the movement paths of the engaging portions 14, the engaging portions 14 can be disengaged from the engaged portions 24 by manipulating the pair of legs 12 such that the engaging portions 14 approach each other. Thus, the socket 20 and the plug 10 can be separated from each other (a double lock disabled state).

In the base portion 31, a protrusion-like stopper 311 extending toward the lock portion 34 is formed near the belt attachment 29. The stopper 311 can be brought into contact with the lock portion 34 to restrict excessive displacement of the cantilever 331 for prevention of unfavorable deformation, damage and the like.

The lock portion 34 includes a guide portion 341 configured to guide the engaging portions 14. The guide portion 341 is formed along a movement locus of each of the engaging portions 14 in insertion of the plug 10 into the socket 20 attached with the lock member 30. In the guide portion 341, a slope is formed on a side where the engaging portions 14 are introduced and a perpendicular surface is formed on a side facing the engaged portions 24. With the guide portion 341 having such an arrangement, disengagement of the engaging portions 14 from the engaged portions 24 can be restricted in the double lock enabled state. Additionally, when the plug 10 is inserted, the engaging portions 14 can be guided while the lock portion 34 and the cantilever 331 are deformed, so that the engaging portions 14 can pass through the guide portion 341.

The exemplary embodiment provides the following advantages.

By attaching the lock member 30 to the buckle 1, which includes the socket 20 provided with the cutouts 25, the double lock function can be added to the buckle 1.

The lock portion 34 is attached to the socket 20 with the assistance of the holder 32 and the base portion 31 is retained along the top side of the socket 20. Simultaneously, the lock portion 34, which is supported by the operating portion 33 and the joint 35 formed on the base portion 31, is positioned in the socket 20 through the cutouts 25.

Without an external operation on the operating portion 33, the lock portion 34 is positioned between the pair of legs 12. Thus, even when a normal unlock operation is performed on the side release buckle 1, i.e., the pair of legs 12 are deformed to approach each other for disengaging the engaging portions 14 from the engaged portions 24 of the socket 20, the lock portion 34 prevents the pair of legs 12 from approaching each other, thereby maintaining engagement between the engaging portions 14 and the engaged portions 24 (the double lock enabled state).

On the other hand, when the operating portion 33 is moved upon an external operation, the lock portion 34, which is connected to the operating portion 33 via the joint 35, is also moved away from the movement paths of the engaging portions 14. In this manner, the double lock enabled state is canceled, so that the normal unlock operation on the side release buckle 1 can be enabled, i.e., the pair of legs 12 can be deformed to approach each other, thereby disengaging the engaging portions 14 from the engaged portions 24 of the socket 20 (the double lock disabled state).

Further, such a double lock function can be eliminated by removing the lock member 30 from the socket 20. After the removal of the lock member 30, the socket 20 and the plug 10 can be used as those of a common side release buckle.

The dimension of the lock member 30 may be changed suitably for a typical side release buckle having a cutout. In this manner, the lock member 30 can be applied to any typical side release buckle used for clothes or bags and thus the double lock function can be added without replacing the buckle.

According to the exemplary embodiment, the operating portion 33 includes the cantilever 331 being continuous with the base portion 31. With such a simple structure, the swinging movement can be realized. The cantilever 331 can be formed integrally with the base portion 31. Additionally, the end of the cantilever 331 is movable sufficiently for allowing the movement of the lock portion 34 as required for the operating portion 33.

With the stopper 311 formed on the base portion 31, excessive displacement of the cantilever 331 can be restricted. Thus, even though the operating portion 33 having a cantilever structure is formed integrally with the base portion 31, it is possible to prevent the operating portion 33 from damage or the like resulting from the excessive displacement.

The holder 32 includes the clamp 321 being positioned on the bottom side of the socket 20 and the stay 322 being configured to connect the base portion 31 and the clamp 321. With this arrangement, the socket 20 can be clamped between the clamp 321 and the base portion 31 on the top and bottom sides thereof, thereby reliably retaining the lock portion 34 relative to the socket 20.

With the clamp nail 32A formed on the clamp 321 and the clamp nail 32B formed on the base portion 31, the holder 32 can hold the edge of the cutouts 28 of the socket 20. As a result, holder 32 can be kept attached at an appropriate position relative to the socket 20 and thus the lock member 30 can be retained relative to the socket 20 with enhanced reliability.

The socket 20 is provided with the undulation 26 formed on the top side of the socket body 21 and the base portion 31 is positioned in the concave of the undulation 26, so that the protruding height from the surface of the socket 20 is reduced for a favorable appearance.

Second Exemplary Embodiment

Figure 11:
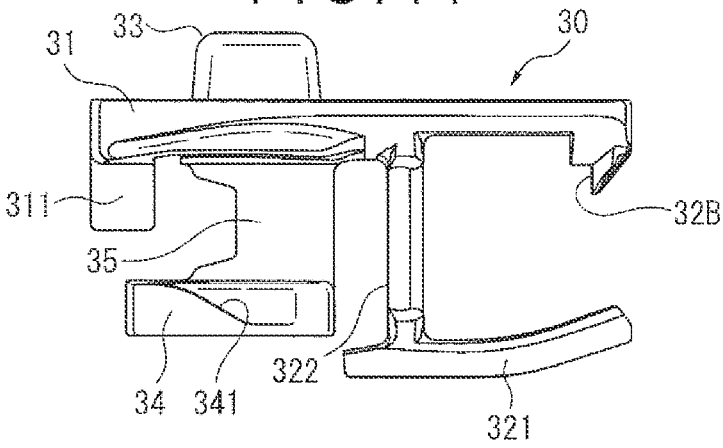
FIG. 11 is a lateral side view showing a lock member according to a second exemplary embodiment of the invention.
Figure 12:
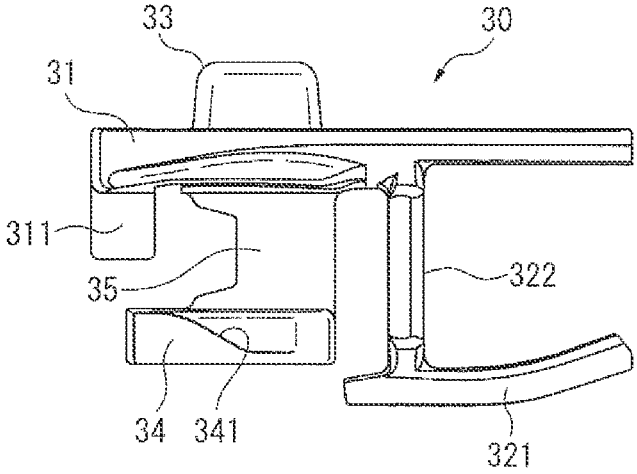
FIG. 12 is a lateral side view showing a lock member according to a third exemplary embodiment of the invention.
Figure 13:
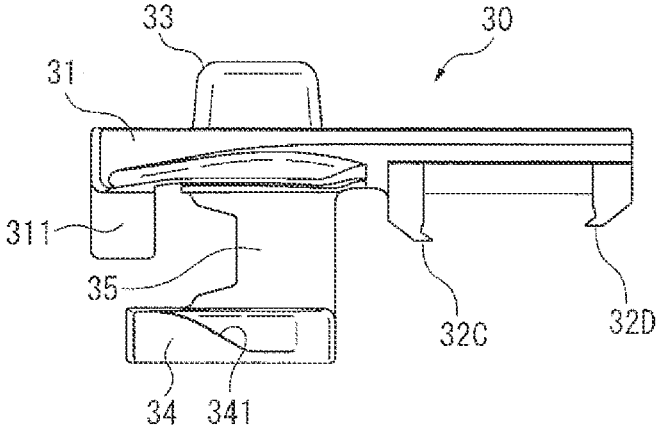
FIG. 13 is a lateral side view showing a lock member according to a fourth exemplary embodiment of the invention.

FIGS. 11 to 13 show second to fourth exemplary embodiments of the present invention.

The basis configurations of these exemplary embodiments are the same as that of the first exemplary embodiment except the holder 32 of the lock member 30. Accordingly, duplicated descriptions will not be provided but only a different part will be described below.

FIG. 11 shows a lock member 30 according to the second exemplary embodiment of the invention.

Compared to the first exemplary embodiment where both the clamp nail 32A of the clamp 321 and the clamp nail 32B of the base portion 31 are used (see FIG. 4), no clamp nail is formed on the clamp 321 but only the clamp nail 32B formed on the base portion 31 is used in the second exemplary embodiment. Even with such a simplified arrangement, it is often possible to sufficiently retain the base portion 31 relative to the socket 20.

FIG. 12 shows a lock member 30 according to the third exemplary embodiment of the invention.

Compared to the first exemplary embodiment where the clamp nail 32A formed on the clamp 321 and the clamp nail 32B formed on the base portion 31 are used (see FIG. 4), no clamp nail is formed on either the base portion 31 or the clamp 321 in the third exemplary embodiment. Even with such a further simplified arrangement, it may be possible to sufficiently retain the base portion 31 relative to the socket 20 as long as the socket 20 is clamped between the clamp 321 and the base portion 31.

FIG. 13 shows a lock member 30 according to the fourth exemplary embodiment of the invention.

Compared to the first exemplary embodiment where the holder 32 includes the clamp 321 and the stay 322 (see FIG. 4), a pair of clamp nails 32C and 32D are formed on a surface of the base portion 31 facing the socket 20 such that the central portion on the top side of the socket 20 (the plate-like portion between the cutouts 25 and 28) is clamped between the clamp nails 32C and 32D in the fourth exemplary embodiment. Even with such a further simplified arrangement, it may be possible to sufficiently retain the base portion 31 relative to the socket 20.

Modification(s)

It should be noted that the invention is not limited to the above arrangements of the exemplary embodiments but encompasses the following modifications.

Although the cutouts 25 and 28 are in the U-shape and the C-shape in the above exemplary embodiments, they may be in a V-shape or a rectangular shape. However, a shape whose innermost is in an arc, such as the U-shape or the C-shape, is preferable for preventing unfavorable stress concentration and securing strength.

Since the lock member 30 is partly inserted in the cutouts 25, the cutouts 25 are necessarily formed but the cutouts 28 may be omitted. In such an arrangement where cutouts 28 are omitted, the edge of the insertion opening 22 becomes closer to the plug 10. Accordingly, it is preferable to, for instance, adjust the length of the base portion 31 or the clamp 321 such that an end of the base portion 31 or the clamp 321 facing the plug 10 reaches the edge of the insertion opening 22.

Although the base portion 31 is provided with the stopper 311 or the lock portion 34 is provided with the guide portion 341 in the above exemplary embodiments, such elements are not essential for the invention and thus can be omitted if necessary.

The details and arrangements of the plug 10 and the socket 20 may be modified or the like if necessary. Additionally, the dimensions, materials, colors, surface finish processes and the like of the plug 10 and the socket 20 may be appropriately selected in implementing the invention.

In the above exemplary embodiments, it is preferable that the plug, the socket and the lock member are integrally formed of a synthetic resin material in the above exemplary embodiments. However, any one of these elements may be formed of a different material such as light alloy or wood.

For providing the buckle with a unified appearance, it is preferable that at least the plug and the socket are formed of the same material and have the same color. Further, if the material and the color of the lock member are also the same as those of the plug and the socket, the buckle can have a unified appearance even when the lock member is attached.

On the other hand, only the lock member may be painted in bright color such as yellow or red, may be formed of a synthetic resin material containing a fluorescent agent or a phosphorescent agent, or may have a surface provided with an eye-catching pattern such as an oblique striped pattern. In this manner, it can be clearly confirmed whether or not the lock member is attached.

The invention claimed is:

1. A side release buckle comprising:

a plug;

a socket into which the plug is inserted for engagement; and a lock member being attachable to the socket to double-lock the plug, wherein the plug comprises:

a plug base comprising a belt attachment;

a pair of legs projecting from the plug base; and engaging portions being formed on the legs, respectively, the socket comprises:

a socket body comprising a belt attachment and an insertion opening;

a housing space being defined in the socket body and in which the legs inserted through the insertion opening are housed;

engaged portions being formed on the socket body and being engageable with the engaging portions, respectively; and a cutout being formed from an edge of the belt attachment toward the insertion opening, the lock member comprises:

a plate-shaped base portion being positioned on a top side of the socket;

a holder being configured to retain the base portion relative to the socket;

an operating portion being connected to the base portion and being movable in a direction intersecting the base portion by an external operation; and a lock portion being configured to restrict disengagement between the engaged portions and the engaging portions, the operating portion comprises a cantilever being continuous with the base portion and being swingable relative to the base portion, and the lock portion is positioned in the socket and is connected to the operating portion via a joint that is to be inserted in the cutout of the socket, the lock portion being present in movement paths along which the engaging portions move to be disengaged from the engaged portions without the external operation on the operating portion, the lock portion being moved away from the movement paths when the operating portion is moved by the external operation.

2. The side release buckle according to claim 1, wherein the base portion comprises a protrusion-like stopper being brought into contact with a part of the lock portion or the cantilever to restrict excessive displacement of the cantilever.

3. The side release buckle according to claim 1, wherein the holder comprises:

a clamp being positioned on a bottom side of the socket; and a stay being configured to connect a surface of the base portion facing the socket to the clamp.

4. The side release buckle according to claim 3, wherein the holder comprises at least one of a clamp nail formed on a surface of the clamp facing the socket and a clamp nail formed on the surface of the base portion facing the socket.

5. The side release buckle according to claim 1, wherein the holder comprises a pair of clamp nails formed on a surface of the base portion facing the socket.

6. The side release buckle according to claim 1, wherein the socket is provided with an undulation formed in a top surface of the socket body, and the base portion is partly positioned in a concave of the undulation.

* * * * *

UNITED STATES PATENT AND TRADEMARK OFFICE

CERTIFICATE OF CORRECTION

PATENT NO. : 8,720,018 B2
APPLICATION NO. : 13/518887
DATED : May 13, 2014
INVENTOR(S) : Kenichi Yoshie et al.

It is certified that error appears in the above-identified patent and that said Letters Patent is hereby corrected as shown below:

In the Specification

In column 1, line 4-5, delete "PCT/W2009/071607" and insert -- PCT/JP2009/071607 --, therefor.

Signed and Sealed this
Twelfth Day of August, 2014

Michelle K. Lee

Michelle K. Lee
*Deputy Director of the United States Patent and Trademark Office*